US011171455B1

(12) United States Patent
Baldwin et al.

(10) Patent No.: US 11,171,455 B1
(45) **Date of Patent: *Nov. 9, 2021**

(54) ELECTRICAL DEVICE

(71) Applicants: Jeffrey P. Baldwin, Anthem, AZ (US); Ryan Liebengood, Gilbert, AZ (US)

(72) Inventors: Jeffrey P. Baldwin, Anthem, AZ (US); Ryan Liebengood, Gilbert, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/002,753

(22) Filed: Aug. 25, 2020

Related U.S. Application Data

(63) Continuation of application No. 16/238,199, filed on Jan. 2, 2019, now Pat. No. 10,756,495, which is a continuation of application No. 15/668,434, filed on Aug. 3, 2017, now Pat. No. 10,170,872, which is a continuation of application No. 14/694,429, filed on Apr. 23, 2015, now Pat. No. 9,728,908.

(60) Provisional application No. 62/104,832, filed on Jan. 18, 2015, provisional application No. 62/047,022, filed on Sep. 7, 2014, provisional application No. 61/991,590, filed on May 11, 2014, provisional application No. 61/988,256, filed on May 4, 2014, provisional application No. 61/987,403, filed on May 1, 2014, provisional application No. 61/987,409, filed (Continued)

(51) Int. Cl.

| | |
|---|---|
| ***H01R 13/71*** | (2006.01) |
| ***H01R 35/04*** | (2006.01) |
| ***H01R 13/20*** | (2006.01) |
| ***H01R 13/639*** | (2006.01) |
| ***H01R 13/453*** | (2006.01) |
| ***H01R 24/76*** | (2011.01) |
| *H01R 103/00* | (2006.01) |
| *H01R 24/78* | (2011.01) |
| *H01R 25/00* | (2006.01) |
| *H01R 13/703* | (2006.01) |

(52) U.S. Cl.

CPC ..... *H01R 13/71* (2013.01); *H01R 13/20* (2013.01); *H01R 13/4532* (2013.01); *H01R 13/4538* (2013.01); *H01R 13/639* (2013.01); *H01R 13/6397* (2013.01); *H01R 24/76* (2013.01); *H01R 35/04* (2013.01); *H01R 13/703* (2013.01); *H01R 24/78* (2013.01); *H01R 25/006* (2013.01); *H01R 2103/00* (2013.01)

(58) Field of Classification Search

CPC .... H01R 13/71; H01R 13/20; H01R 13/4532; H01R 13/4538; H01R 13/639; H01R 13/6397; H01R 24/76; H01R 35/04; H01R 2403/00

See application file for complete search history.

(56) References Cited

U.S. PATENT DOCUMENTS

| | | | |
|---|---|---|---|
| 1,933,592 | A | 11/1933 | Hubbell |
| 2,239,653 | A | 4/1941 | O'Brien |

(Continued)

*Primary Examiner* — Tho D Ta

(74) *Attorney, Agent, or Firm* — Booth Udall Fuller, PLC

(57) ABSTRACT

An electrical receptacle including a body having a first cavity and a second cavity, a plurality of first electrical connections in the first cavity and a plurality of second electrical connections in the second cavity, at least one electrical plug sensing device in the first cavity, and wherein electrical continuity to the plurality of first electrical connections from the plurality of second electrical connections only occurs when the at least one electrical plug sensing device senses a presence of an electrical plug in the first cavity.

17 Claims, 17 Drawing Sheets

Related U.S. Application Data on May 1, 2014, provisional application No. 61/987,400, filed on May 1, 2014, provisional application No. 61/984,042, filed on Apr. 25, 2014, provisional application No. 61/984,261, filed on Apr. 25, 2014.

(56) References Cited

U.S. PATENT DOCUMENTS

| | | | | |
|---|---|---|---|---|
| 3,478,297 | A | 11/1969 | Gimpel | |
| 4,659,161 | A * | 4/1987 | Holcomb | H01R 31/02 439/490 |
| 4,722,693 | A | 2/1988 | Rose | |
| 5,551,893 | A | 9/1996 | Johnson | |
| 6,332,794 | B1 | 12/2001 | Tzeng | |
| 6,537,089 | B1 | 3/2003 | Montague | |
| 6,984,141 | B1 | 1/2006 | Beski | |
| 7,967,620 | B1 * | 6/2011 | Baldwin | H01R 13/713 439/188 |
| 9,450,365 | B1 | 9/2016 | Baldwin | |
| 10,170,872 | B1 | 1/2019 | Baldwin | |
| 10,756,495 | B1 * | 8/2020 | Baldwin | H01R 13/4532 |
| 2002/0097546 | A1 | 7/2002 | Weinberger | |

* cited by examiner

PLUG NOT PUSHED IN - CONTACT OPEN
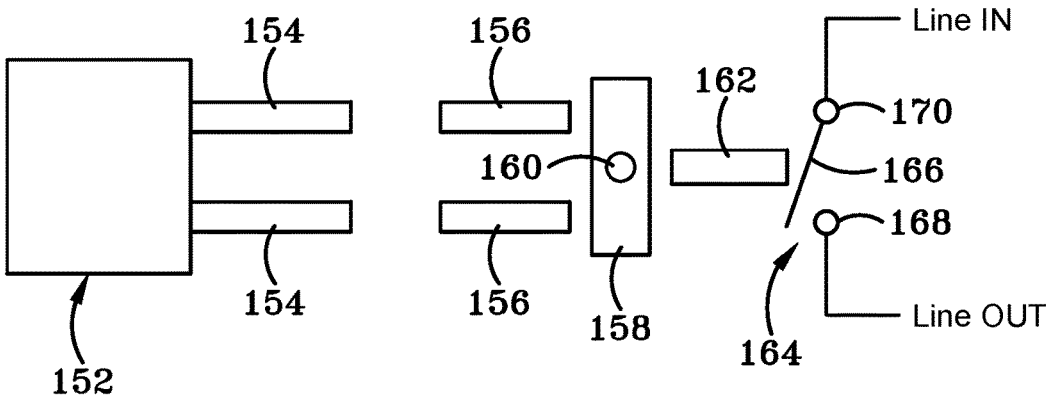
PLUG PUSHED IN - CONTACT CLOSED
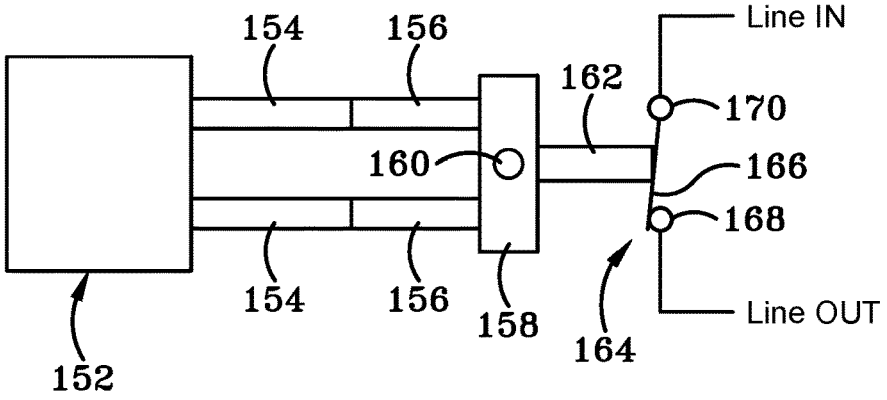
FIG-20
FOREIGN OBJECT PUSHED IN - CONTACT OPEN
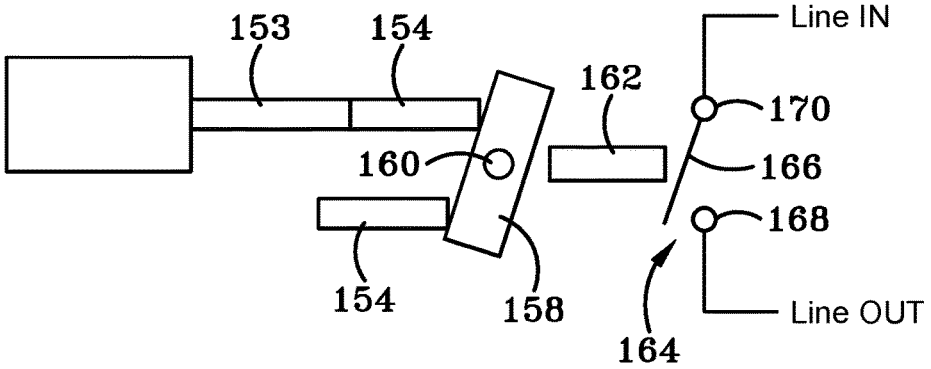

ELECTRICAL DEVICE

CROSS-REFERENCE TO RELATED APPLICATIONS

This application is a continuation of U.S. patent application Ser. No. 16/238,199, filed Jan. 2, 2019 and issued as U.S. Pat. No. 10,756,495 on Aug. 25, 2020, which application is a continuation of U.S. patent application Ser. No. 15/668,434, filed on Aug. 3, 2017 and issued as U.S. Pat. No. 10,170,872 on Jan. 1, 2019, which application is a continuation U.S. patent application Ser. No. 14/694,429, filed on Apr. 23, 2015 and issued as U.S. Pat. No. 9,728,908 on Aug. 8, 2017, which application claims priority to Provisional U.S. Patent Application No. 61/987,400, filed on May 1, 2014 and titled LINEAR LOCKABLE ELECTRICAL DEVICE to Baldwin et al., the disclosures of which are hereby incorporated herein by reference. U.S. patent application Ser. No. 14/694,429 also claims priority to Provisional U.S. Patent Application No. 61/987,409, filed on May 1, 2014 and titled LOCKABLE ELECTRICAL DEVICE WITH BUTTON RELEASE to Baldwin et al., and also claims priority to Provisional U.S. Patent Application No. 61/984,042, filed on Apr. 25, 2014 and titled LOCKABLE ELECTRICAL DEVICE to Baldwin et al., and also claims priority to Provisional U.S. Patent Application No. 61/984,261, filed on Apr. 25, 2014 and titled WEATHERPROOF SELF-SECURING ELECTRICAL RECEPTACLE to Baldwin et al., and also claims priority to Provisional U.S. Patent Application No. 61/987,403, filed on May 1, 2014 and titled INWARD LOCKABLE ELECTRICAL DEVICE to Baldwin et al., and also claims priority to Provisional U.S. Patent Application No. 61/988,256, filed on May 4, 2014 and titled CAM ENGAGEMENT ROTATABLE DEVICE to Baldwin et al., and also claims priority to Provisional U.S. Patent Application No. 61/991,590, filed on May 11, 2014 and titled LOCKING ROTATABLE DEVICE AND CORD LOCK to Baldwin et al., and also claims priority to Provisional U.S. Patent Application No. 62/047,022, filed on Sep. 7, 2014 and titled WATER RESISTANT CORD END to Baldwin et al., and also claims priority to Provisional U.S. Patent Application No. 62/104,832, filed on Jan. 18, 2015 and titled ELECTRICALLY ISOLATED RECEPTACLE to Baldwin et al., the disclosures of which are all hereby incorporated herein by reference. This application hereby incorporates by reference co-filed applications LOCKING ELECTRICAL DEVICE and LINEAR LOCKING ELECTRICAL DEVICE, both to Baldwin et al. and filed on the same day as U.S. patent application Ser. No. 14/694,429.

BACKGROUND

Electrical devices and receptacles are well known to provide electrical current to a number of devices within a building once connected to the electrical receptacle. Some features of electrical devices include tamper resistant shutters to prevent inappropriate access to the device and to make sure the electrical device is as safe as possible.

SUMMARY

Aspects of this disclosure relate to an electrical receptacle. The electrical receptacle may include a body having a plurality of electrical connections, a device face connected to the body, and wherein the device face is movable with respect to the body from an electrically inactive position to an electrically active position.

In an implementation, a plurality of electrical receptacle apertures are located on the device face. The device face may be rotatable with respect to the body. At least one pair of electrical contacts may be located in electrical continuity when the electrical receptacle is in an electrically active position. A tab may move at least one of the pair of electrical contacts to change the electrical receptacle from an electrically inactive position to an electrically active position. The tab may be positioned on a perimeter of the device face. The tab may move a plurality of electrical contacts.

A plug contact may be aligned with each of the electrical receptacle apertures and the plug contacts are electrically inactive when the electrical receptacle is in an electrically inactive position. A rotation limiter may be positioned on a front surface of the device face. The electrical device may be electrically active when the rotation limiter is contacted in a first direction. The device face may further include at least two electrical pins extending rearward and in selective electrical communication with a plurality of electrical contacts. The plurality of electrical contacts may be fixed. The at least two electrical pins may move with the device face. The movement may be rotational. The at least two electrical pins may be in electrical communication with the electrical contacts upon movement of the device face to the electrically active position.

The device face may include at least two electrical pins extending from a perimeter of the device face and in selective electrical communication with a plurality of electrical contacts. The device face may be rotatable more than 360 degrees. The electrical device may be electrically active in at least three rotational positions and electrically inactive otherwise. An indicator may identify when the device face is in the electrically active position. A tamper resistant mechanism may be overcome before the electrical receptacle is electrically active.

Aspects and applications of the disclosure presented here are described below in the drawings and detailed description. Unless specifically noted, it is intended that the words and phrases in the specification and the claims be given their plain, ordinary, and accustomed meaning to those of ordinary skill in the applicable arts. The inventors are fully aware that they can be their own lexicographers if desired. The inventors expressly elect, as their own lexicographers, to use only the plain and ordinary meaning of terms in the specification and claims unless they clearly state otherwise and then further, expressly set forth the "special" definition of that term and explain how it differs from the plain and ordinary meaning. Absent such clear statements of intent to apply a "special" definition, it is the inventors' intent and desire that the simple, plain and ordinary meaning to the terms be applied to the interpretation of the specification and claims.

The inventors are also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

Embodiments of the present invention will hereinafter be described in conjunction with the appended drawings, where like designations denote like elements, and:

FIG. 2 is a rear view of the electrical receptacle face taken generally about line 2-2 in

FIG. 1.

FIG. 3 is a sectional view of the electrical receptacle taken generally about line 3-3 in

FIG. 2.

FIG. 5 is a rear view of the electrical receptacle face taken generally about line 5-5 in

FIG. 4.

FIG. 14 is a sectional view of the electrical cord taken generally about line 14-14 in

FIG. 13.

FIG. 20 is a schematic view of a tamper resistant electrical device with an electrically isolating feature.

DETAILED DESCRIPTION

Figure 1:
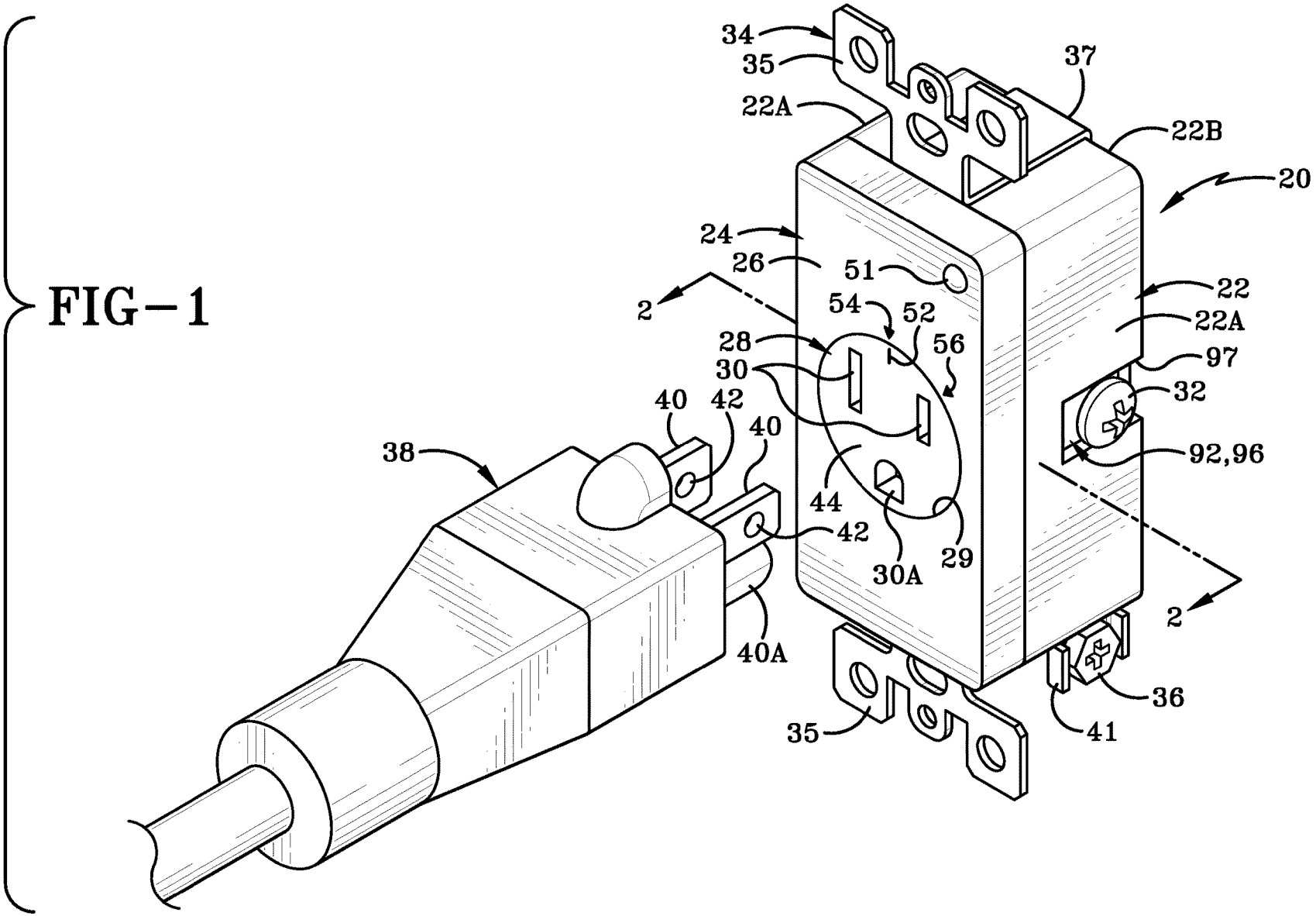
FIG. 1 is a perspective view of a first aspect electrical receptacle with an electrical plug separated.

This disclosure, its aspects and implementations, are not limited to the specific components or assembly procedures disclosed herein. Many additional components and assembly procedures known in the art consistent with the intended operation and assembly procedures for an electrical receptacle or electrical cord will become apparent for use with implementations of an electrical receptacle from this disclosure. Accordingly, for example, although particular components are disclosed, such components and other implementing components may comprise any shape, size, style, type, model, version, measurement, concentration, material, quantity, and/or the like as is known in the art for such implementing components, consistent with the intended operation of an electrical receptacle or electrical cord.

FIGS. 1-5 illustrate various views of an electrical receptacle 20 having a rear body 22 and a front body 24. Rear body 22 includes sidewalls 22A and back walls 22B which together form an internal cavity (not specifically shown) to receive a number of electrical connections as may be known in the art to connect the electrical receptacle to an electrical power supply. Front body 24 may include a top ball, side walls, and bottom walls, as well as a front surface 26. A device face 28 is positioned on or in front body 24 and preferably on or in front surface 26 at a hole 29 therein. In one implementation, device face 28 may be round, square, triangular, or any other suitable shape or size and may be a plurality of device faces on a single electrical receptacle without departing from the spirit and scope of the present disclosure.

Device face 28 includes receptacle openings 30 and a ground prong opening 30A in one implementation and the device face may include a pointer line 52 on a front surface 44 which rotates with the device face to align with a first arrow 54 or a second arrow 56 which provide visual confirmation between an electrically inactive position (first arrow 54 in this example) and an electrically active position (second arrow 56 in this example). Still further, front surface 26 may include an indicator 51 which also provides visual feedback as to whether the electrical receptacle (or electrical cord end in later embodiments) is in an electrically inactive position (no light for example) or in an electrically active position (indicator light on for example).

Electrical receptacle or device 20 may also include a yoke 34 having mounting flanges 35 and a vertical portion 37 there between. Electrical connection screws 32 are used for hot and line connections at connectors 92 of receiving arms 96 which may be accessible through an aperture 97 in sidewall 22A. In this manner, electrical current from the building can be connected to the electrical receptacle through the various connectors 92 of the electrical receptacle as is well known in the art. Further, a grounding screw 36 may be positioned on a ground wire connection tab 41.

Moving to electrical plug 38, the electrical plug may include one or more plug blades 40 having apertures 42 near an end thereof. A ground prong 40A may also be positioned on the electrical plug in three prong electrical plugs commonly used in the U.S. In another implementation, two plug blades 40 may be utilized without a separate ground prong as is known in the art.

Figure 2:
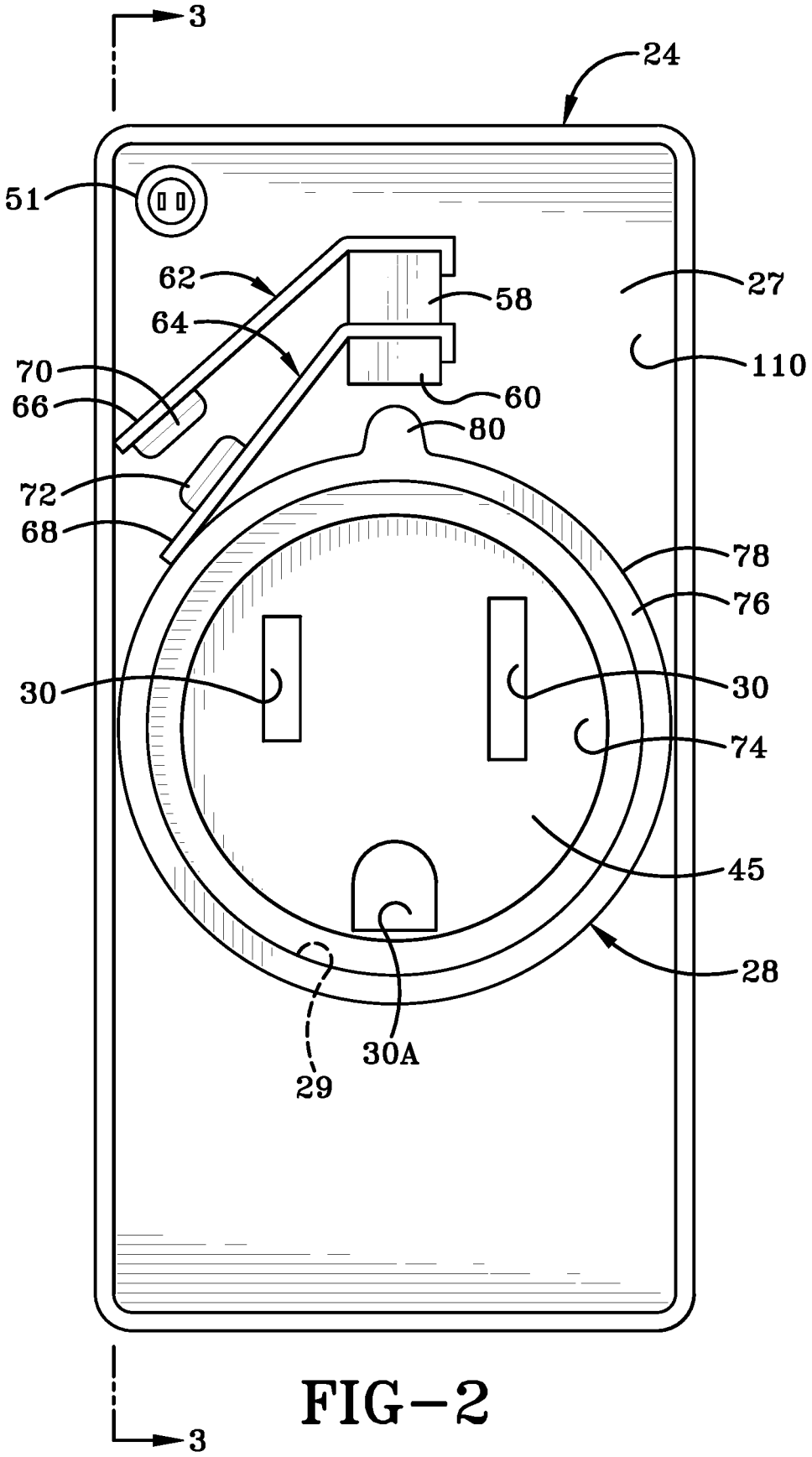

Moving to FIG. 2, which is a rear view of the front body 24 separated from rear body 22. A rear surface 27 of front body 24 may form a portion of a cavity 110, while a rear surface 45 of device face 28 may be positioned within a cavity 74 formed by walls of device face 28 extending rearward at a position radially outward of receptacle openings 30 and ground prong opening 30A. An engagement ring 76 may be secured around device face 28 and may rotate with the device face during operation. The engagement ring 76 may also include a perimeter 78 with a tab 80 extending radially outward from the perimeter 78. Tab 80 may be rounded, square, circular or any other suitable shape to adequately engage and interact with various components in the electrical receptacle.

A first contact mount 58 and a second contact mount 60 are both positioned within cavity 110 and arranged to secure first contact 62 and second contact 64 respectively. Contacts 62 and 64 are used to electrically isolate electrical contacts positioned behind receptacle openings 30 as is known in the art. The electrical connections (not shown) behind receptacle openings 30 are each arranged to receive one of the plug prongs 40 therein and are well known in the industry. The first contact 62 includes a first end 66 having a button 70 and second contact 64 includes a first end 68 having a button 72. Buttons 72 may be composed of the same material as each other and contacts 62 and 64 or may be a different material such as silver or other suitable materials which resist shorting and limit spark generation. Contacts 62 and 64 are connected to electrical wires or plates which transmit current to one of the contacts 62 or 64 and then flow from the other of the contacts 62 or 64 to the electrical connections positioned behind the receptacle openings 30 and ultimately to the electrical plug prongs 40 when properly inserted into electrical receptacle 20. Advantageously, this structure allows the electrical receptacle to be electrically inactive at the device face receptacle openings when buttons 70 and 72 are not in connected, but to then be electrically active at the device face receptacle openings when buttons 70 and 72 are connected or compressed with each other. To be clear, electrical connections behind the receptacle openings are similar to those electrical prongs known in the art that frictionally engage electrical plug prongs 40 and 40A but the electrical connections are not able to convey electrical current to the electrical plug prongs 40 and 40A until buttons 70 and 72 are engaged with each other. This structure provides a safer electrical outlet with less chance of electrical shock.

Figure 3:
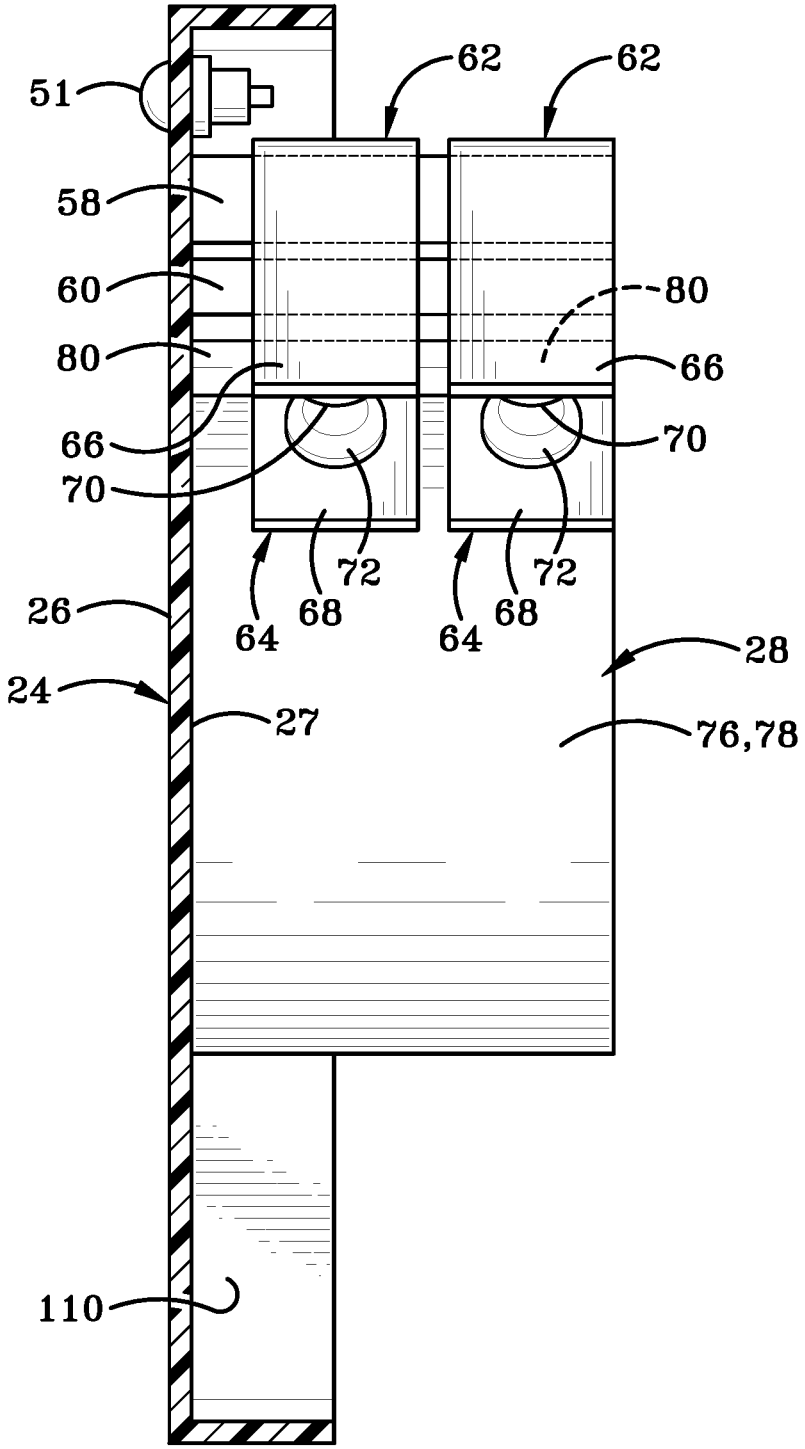

FIG. 3 illustrates a sectional view of the front body with multiple sets of electrical contacts 62 and 64. Specifically, the second set of electrical contacts to the right of the first set shown in FIG. 2 function and operate in a manner identical to those shown and described in FIG. 2. Specifically, even the same tab 80 may be utilized to engage both sets of contacts at the same time. Nevertheless, two contact sets may be utilized as shown in FIG. 3 so that one set of contacts may electrically isolate the hot circuit while the second set of contacts may electrically isolate the line circuit. Still further a single set of electrical contacts 62 and 64 may be used to electrically isolate only one of the hot or line circuits such that a complete circuit may be achieved with only one set of contacts. Even further, one set of contacts may include two isolated regions each such that only one set of contacts can make both the hot and line circuits electrically isolated and electrically active without departing from the spirit and scope of the present disclosure.

Figure 4:
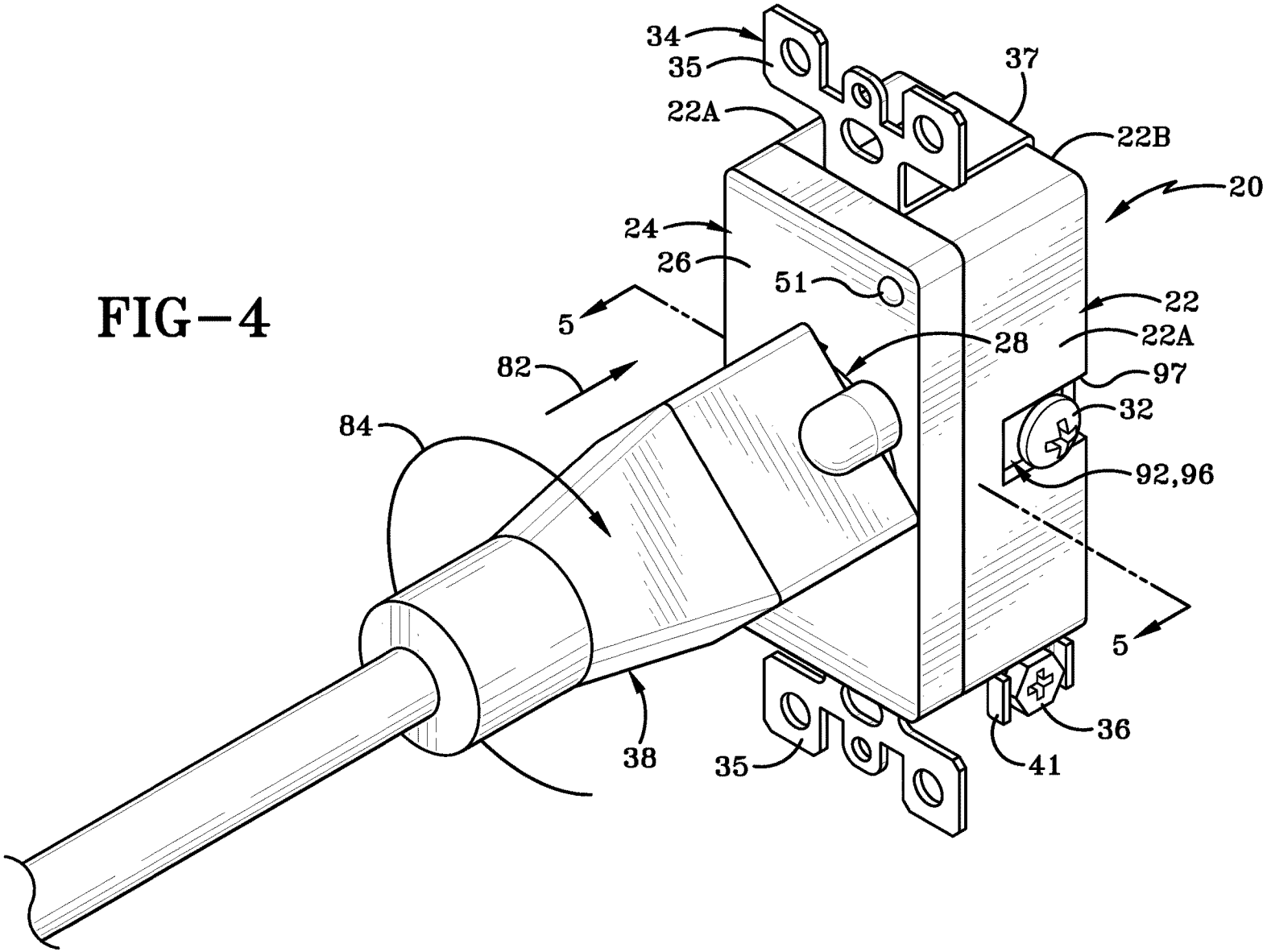
FIG. 4 is a perspective view of the electrical receptacle with an electrical plug inserted and rotated to the electrically active position.
Figure 5:
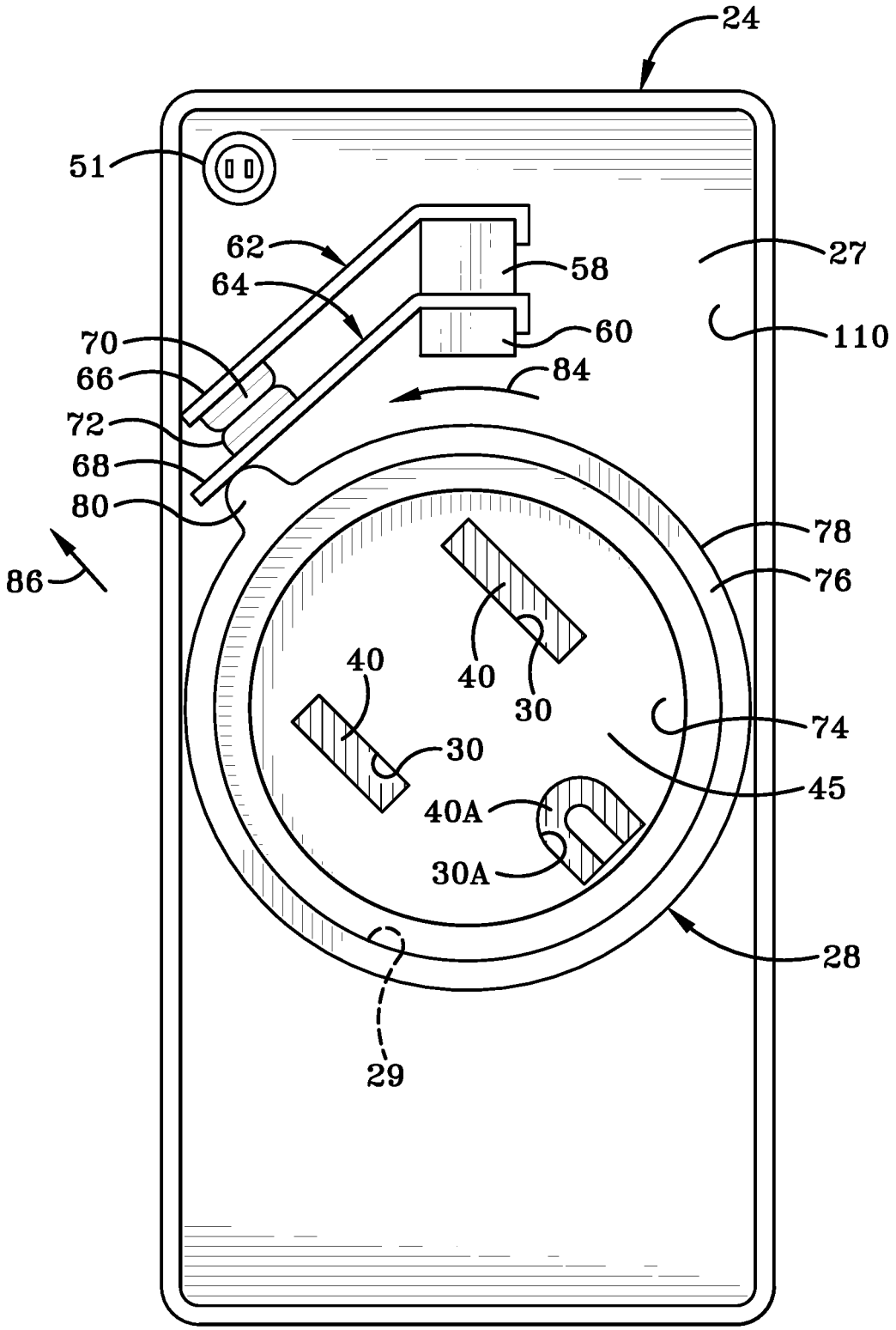

FIGS. 4 and 5 illustrate views of the electrical receptacle 20 with electrical plug 38 inserted and are otherwise similar to FIGS. 1 and 2. In operation, electrical plug 38 is inserted into electrical receptacle 20 in the direction associated with arrows 82 until plug blades 40 and ground prong 40A are inserted through receptacle openings 30 and ground prong openings 30A. At this point electrical plug 38 may be rotated in the direction associated with arrows 84 until the device face 28 reaches an electrically active position. As device face 28 is rotated in the direction associated with arrows 84, tab 80 rotates with the device face while it contacts second electrical contact 64 and particularly first end 68 to force first end 68 in the direction associated with arrow 86. The position of tab 80 during the rotation forces the buttons 70 and 72 in electrical communication with each other, thereby closing the circuits of the hot and line voltage electrical circuits. In this position shown in FIG. 5, the electrical receptacle 20 is in the electrically active position because current can flow from the first contact 62 and through the second contact 64 to ultimately reach electrical plug blades 40 and ground prong 40A. When the electricity is no longer needed, the user can simply rotate the device face in the direction opposite arrows 84 to permit electrical contacts 62 and 64 to return to their original, relaxed state where buttons 70 and 72 are no longer in electrical communication because tab 80 is no longer physically forcing the contacts into engagement.

In either orientation, the user may be able to remove electrical plug 38 while the electrical receptacle is in the electrically active position. It is within the spirit and scope of the present disclosure to incorporate a locking mechanism which prevents or limits the removal of electrical plug 38 in the electrically active position unless a certain removal force is achieved as disclosed in the co-filed applications titled LOCKING ELECTRICAL DEVICE and LINEAR LOCKING ELECTRICAL DEVICE, both to Baldwin et al., the disclosures of which are hereby incorporated herein by reference.

In an implementation, the electrical plug 38 may be removed after a specified amount of force, such as 50 pounds of pulling force, thereby permitting the electrical plug to be removed without inadvertently dislodging the electrical receptacle. Specifically, the electrical plug is removable from the electrical device with less than 15 pounds of removal force in the unlocked position and in one implementation between 3 to 15 pounds of force removes the plug as identified in UL498. In another implementation, the removal force in the unlocked position is between 0 and 30 pounds of removal force. In the locked position, the removal force may be higher. The removal force in the locked position may be between 32 and 38 pounds of removal force or between 25 and 50 pounds of removal force in another implementation. As can be seen, any suitable holding force may be utilized in the locked position, such as between 25 to 50 plus pounds of removal force as the electrical code, UL, and various requirements may specify. In another implementation, the removal force may be less than 20 or 15 pounds. Accordingly, any suitable unlocked and locked removal force may be utilized to secure the electrical cord within the receptacle when an electrical plug locking structure is incorporated. While the above description relates to a three prong electrical plug, a similar analysis may be accomplished for a two prong electrical plug whereby the two prong electrical plug may have higher or lower removal force in the locked or unlocked positions selectively and may be between 0 and 50 plus pounds.

Figure 7:
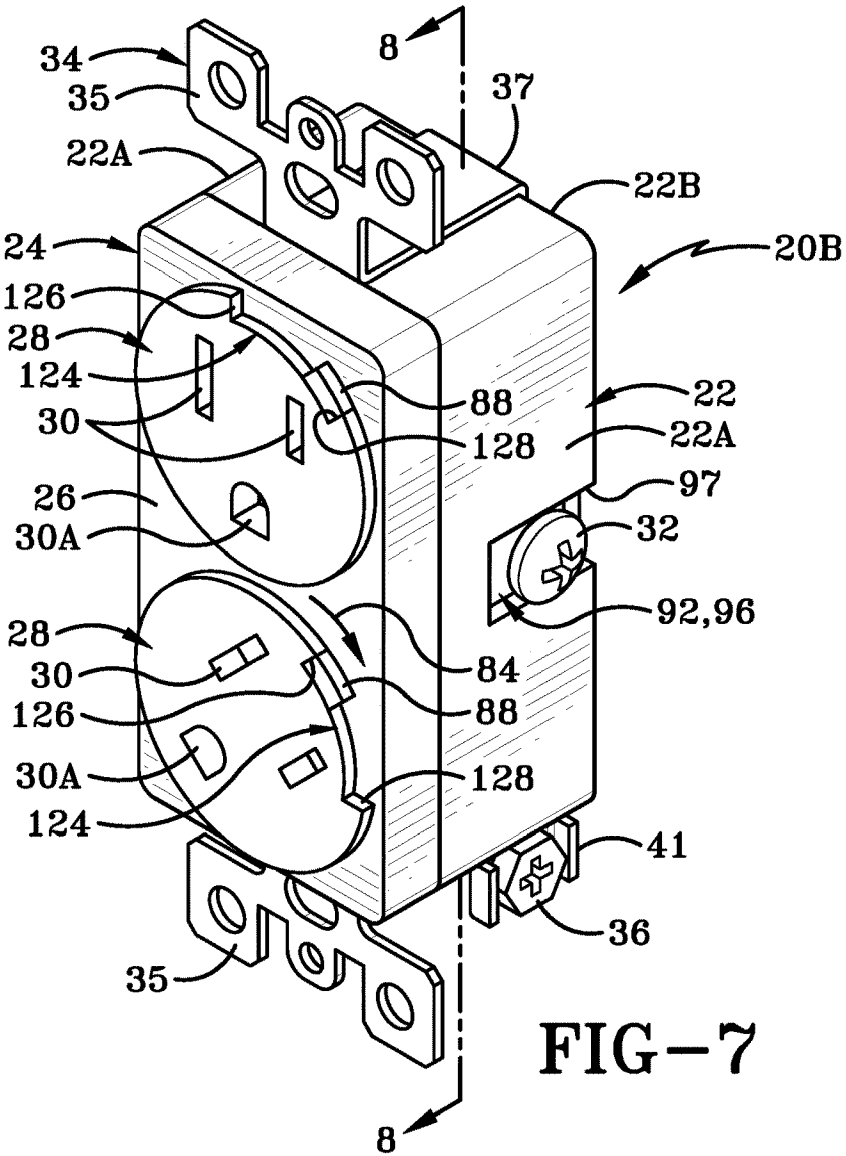
FIG. 7 is a third aspect electrical receptacle with an upper device face in an electrically inactive position and a lower device face in an electrically active position.
Figure 6:
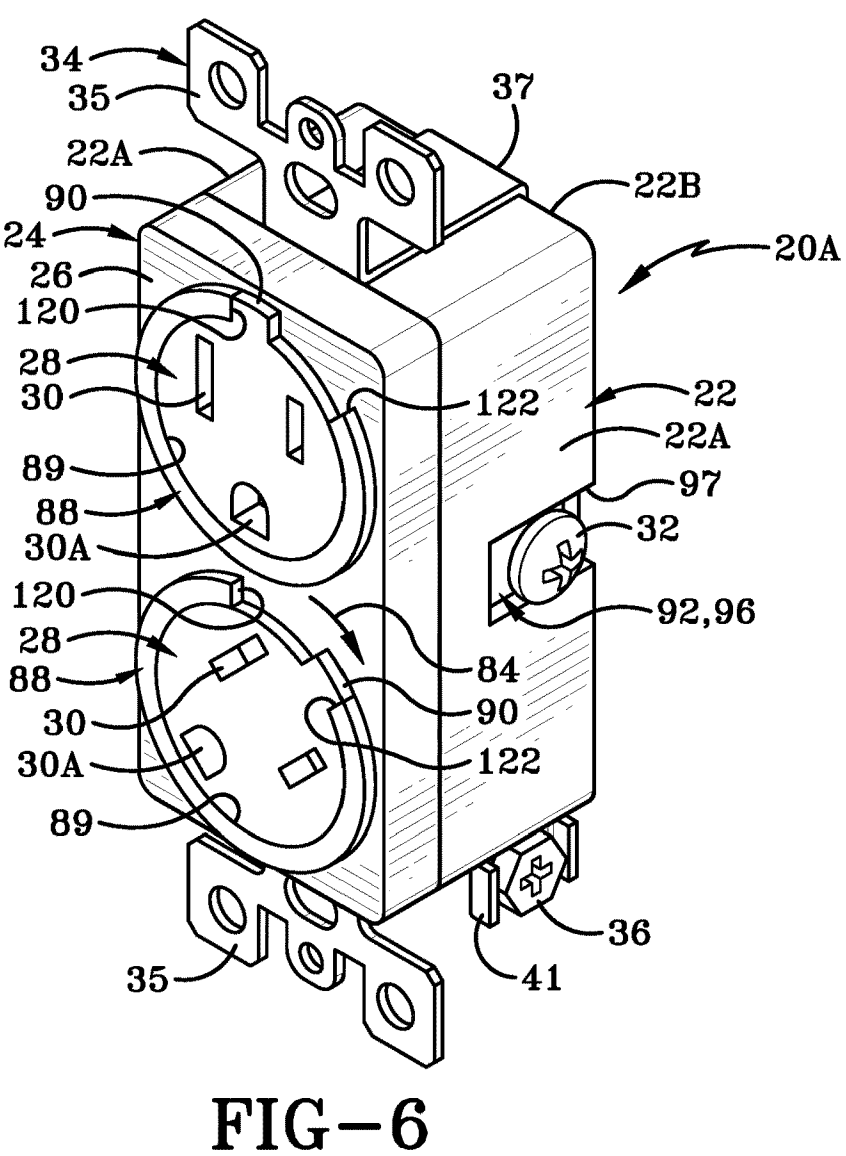
FIG. 6 is second aspect electrical receptacle with an upper device face in an electrically inactive position and a lower device face in an electrically active position.
Figure 8:
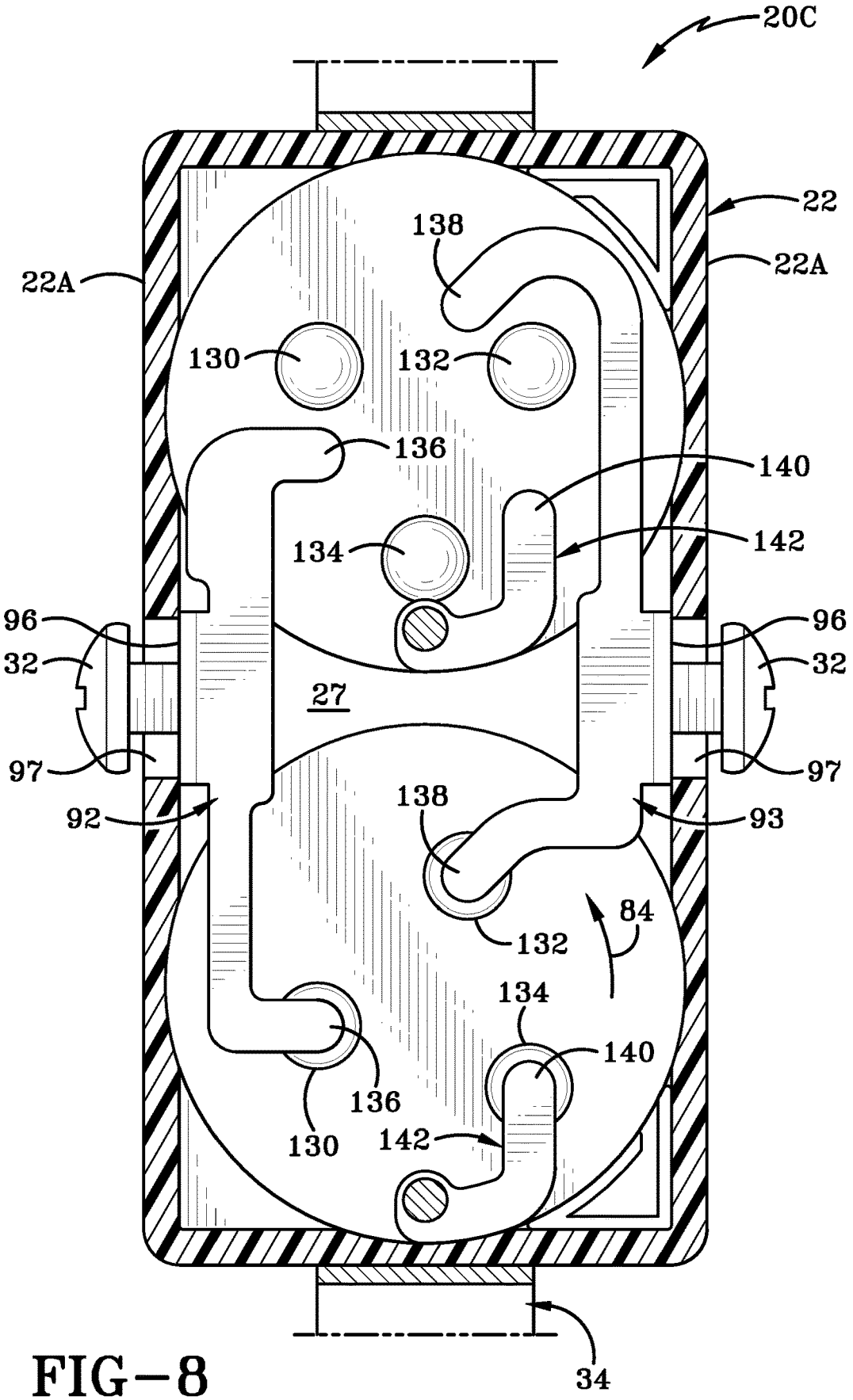
FIG. 8 is a partial sectional view taken generally about line 8-8 in FIG. 7.

FIGS. 6 through 8 illustrate two additional embodiments of an electrical receptacle 20A and 20B. Electrical receptacles 20A and 20B are similar to one another but each include a slightly different device face 28 structure as will be described in greater detail below but retain the same operational features within electrical receptacle 20A and 20B.

Electrical receptacle 20A in FIG. 6 illustrates a top device face 28 in the inactive position and a bottom device face 28 rotated in the direction associated with arrow 84 to put the bottom device face into an electrically active position. A rotation limiter 88 includes a first end 120 and a second end 122. A perimeter 89 of rotation limiter 88 at least partially surrounds device face 28 while a limiter tab 90 extends radially outward of device face 28. Device face and limiter tab 90 are thus rotatable between a first position where limiter tab 90 contacts first end 120 and a second position where limiter tab 90 contacts a second end 122.

Electrical receptacle 20B in FIG. 7 illustrates device face 28 having a rotation recess 124. The rotation recess includes a first end 126 and 128 which are used to contact rotation limiter 88. Specifically, rotation limiter 88 remains stationary while device face and rotation recess 124 rotate between a first position shown in the top device face and a second position shown in the bottom device face. As such, when the device face is rotated counterclockwise until second end 128 contacts rotation limiter 88, the electrical device is in the electrically inactive position. Further, when the device face is rotated clockwise until first end 126 contacts rotation limiter 88, the electrical device is in the electrically active position.

FIG. 8 illustrates the electrical receptacles 20A and 20B shown with a rear portion removed. Each device includes a first pin 130, a second pin 132, and a third pin 134, each of which provide a connection to a hot circuit, a line circuit, or a ground circuit. Connectors 92 include contactor ends 136 which are arranged to connect with first pins 132 when the electrical device is rotated to the electrically active position as shown in the bottom device and to not be in contact when the electrical device is rotated to the electrically inactive position as shown in the top electrical device. Similarly, connector 93 includes connector ends 138 which function to electrically connect second pins 132 when rotated from the first electrically inactive position to an electrically active position. Moving on to the third pin 134, which is commonly, but not limited to, the ground pin which electrically connects to third connector end 140 of ground connector 142. As such, when the device face is rotated in the direction associated with arrow 84 into the electrically active position as shown in the bottom device, the electrical device can selectively provide electrical continuity to an electrical plug.

Figure 9:
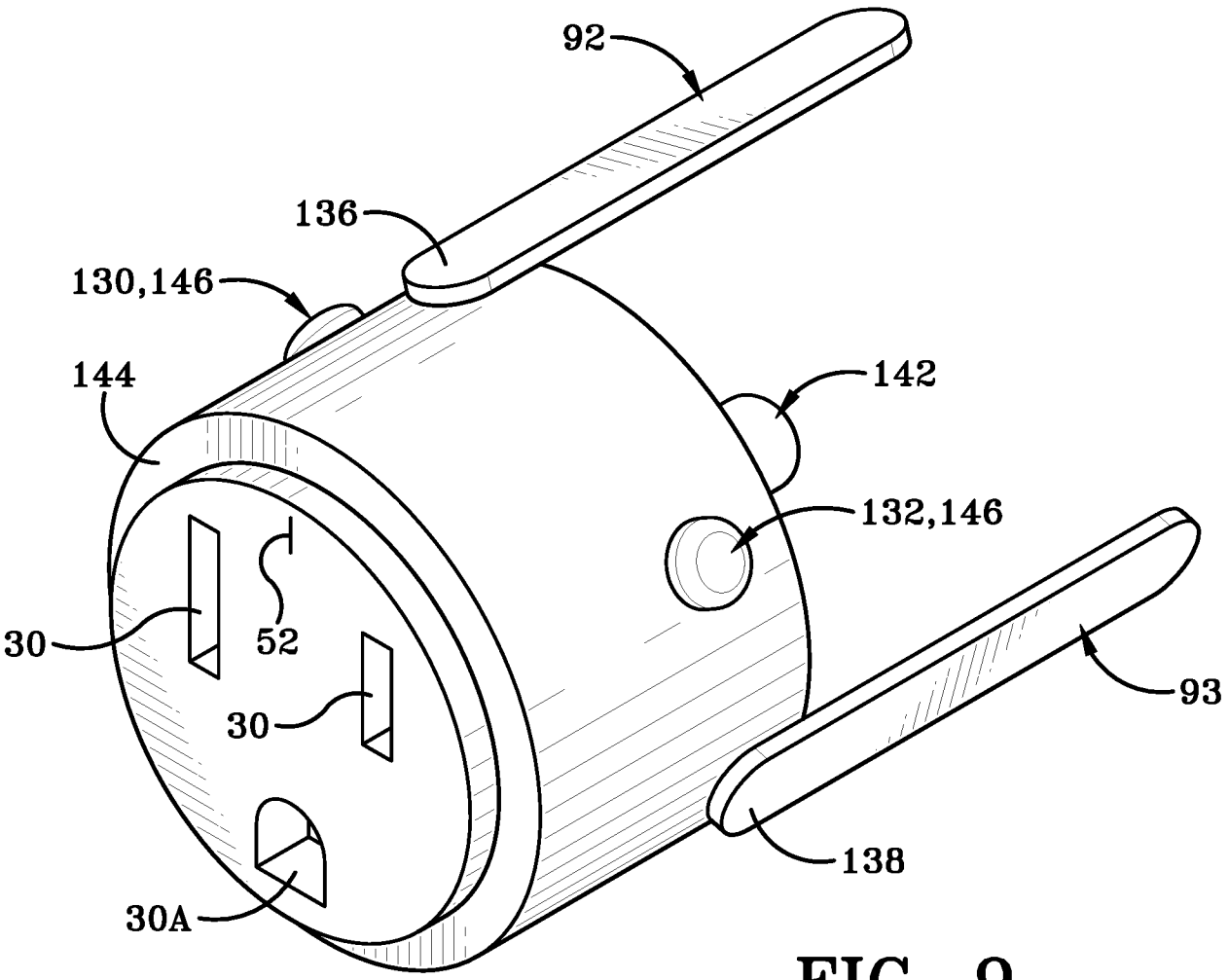
FIG. 9 is a partial exploded schematic perspective view of a fourth aspect electrical device face.
Figure 10:
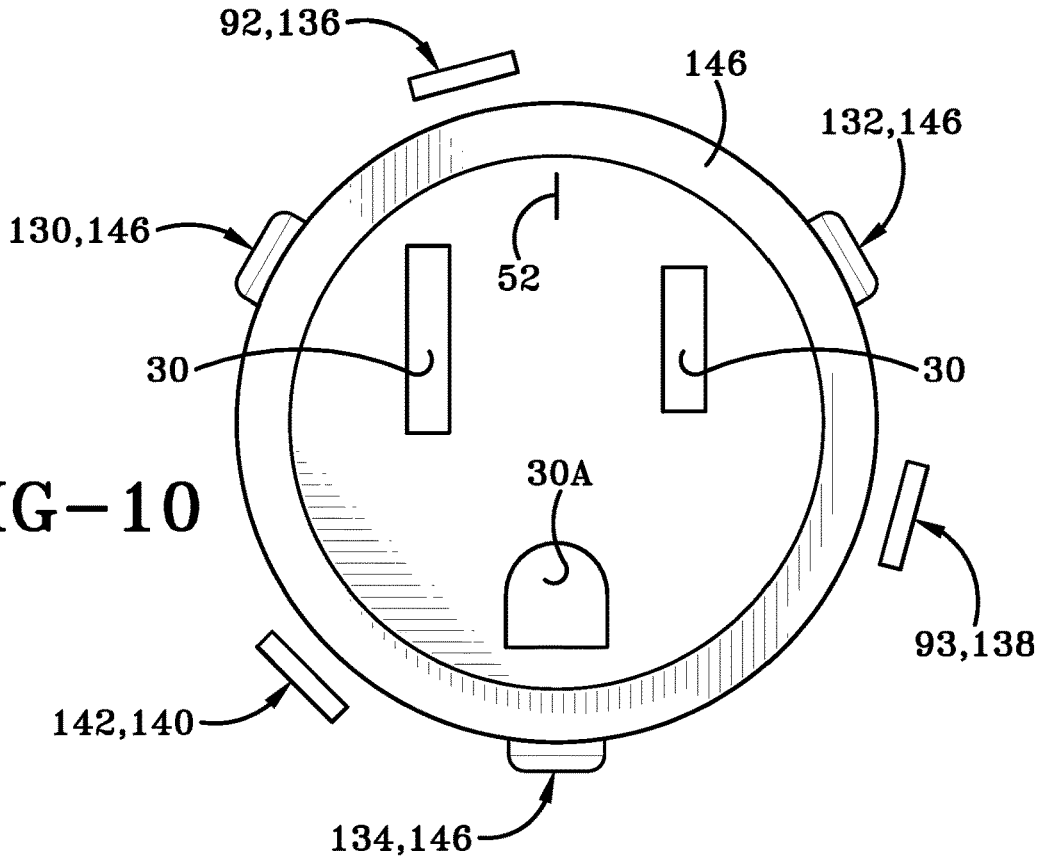
FIG. 10 is a front view of the fourth aspect electrical device face in an electrically inactive position.
Figure 11:
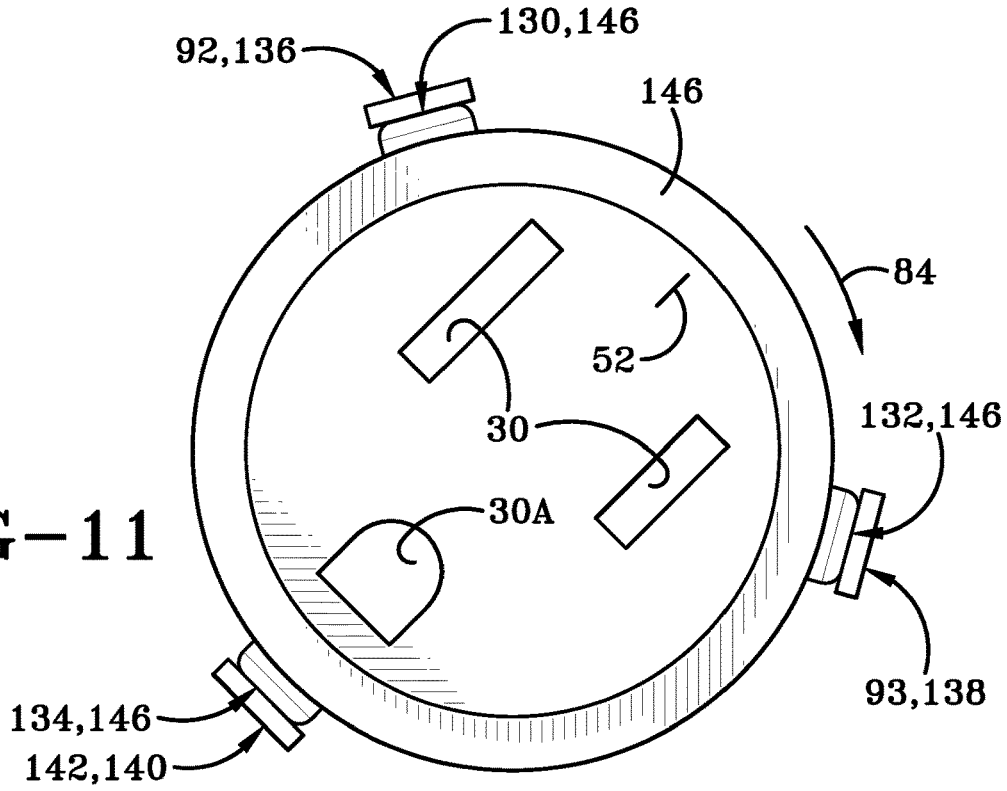
FIG. 11 is a front view of the fourth aspect electrical device face in an electrically active position.
Figure 12:
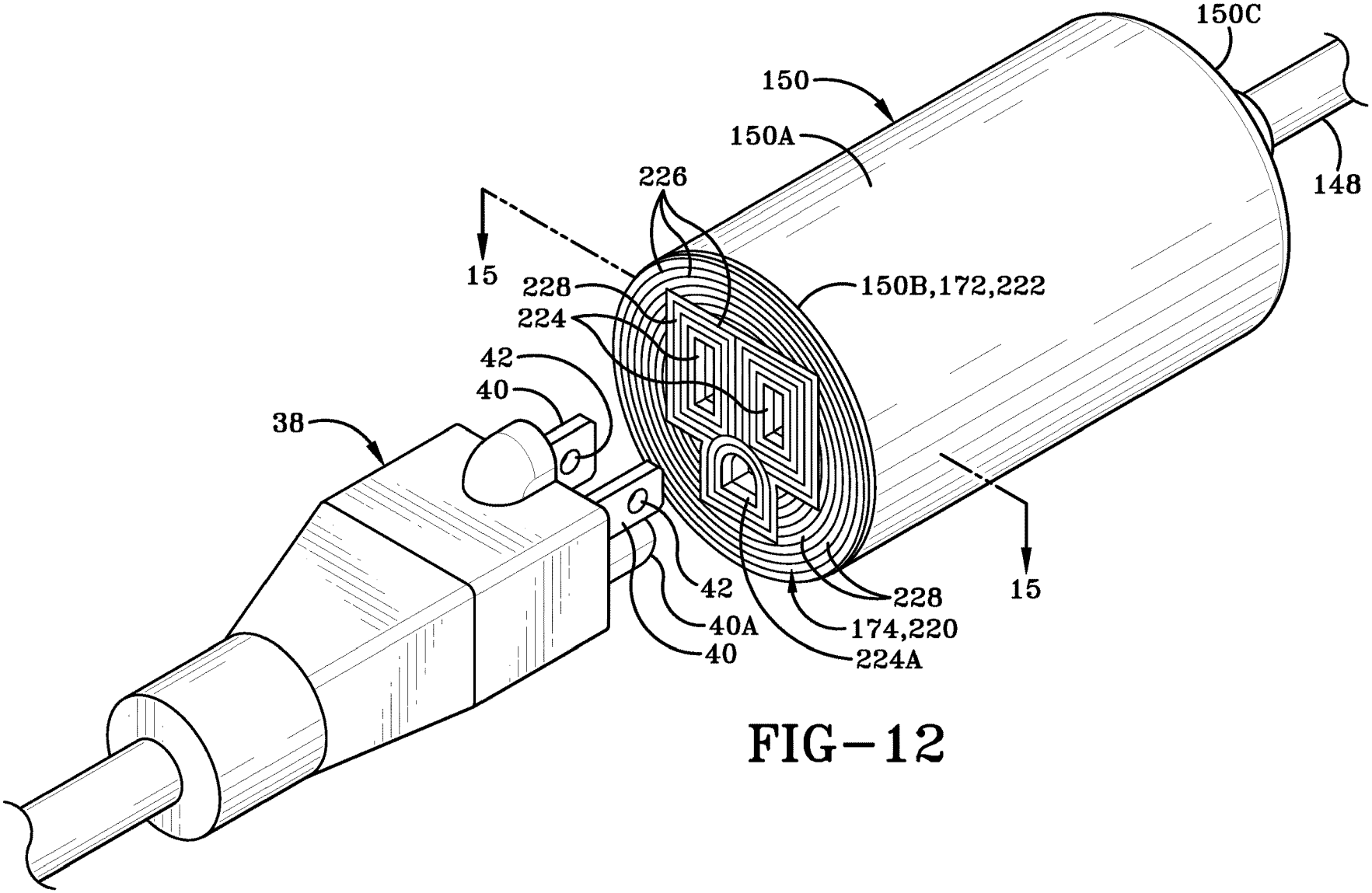
FIG. 12 is a perspective view of a first aspect electrical cord having a separated from an electrical plug.
Figure 13:
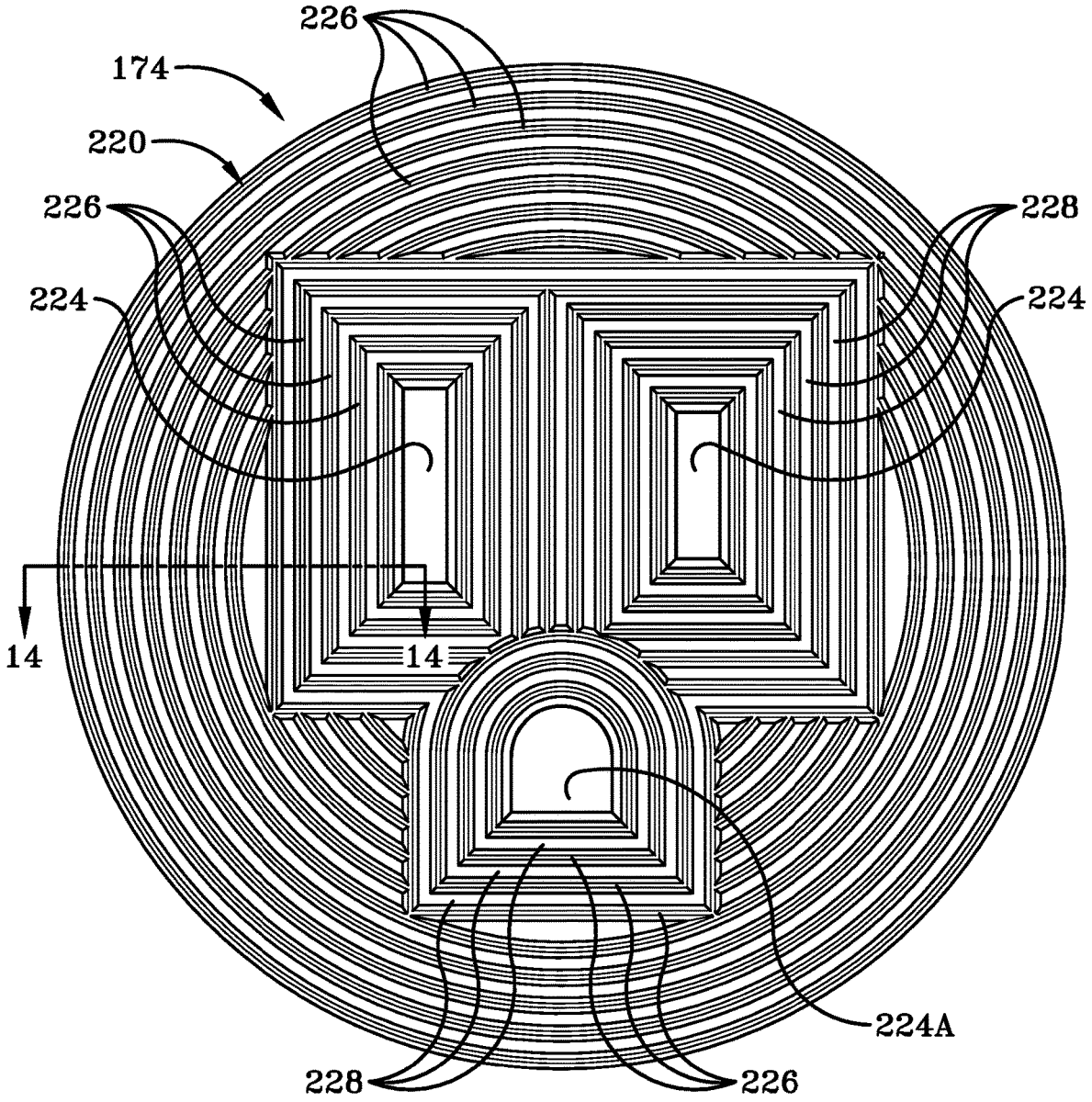
FIG. 13 is a front view of the first aspect electrical cord.
Figure 14:
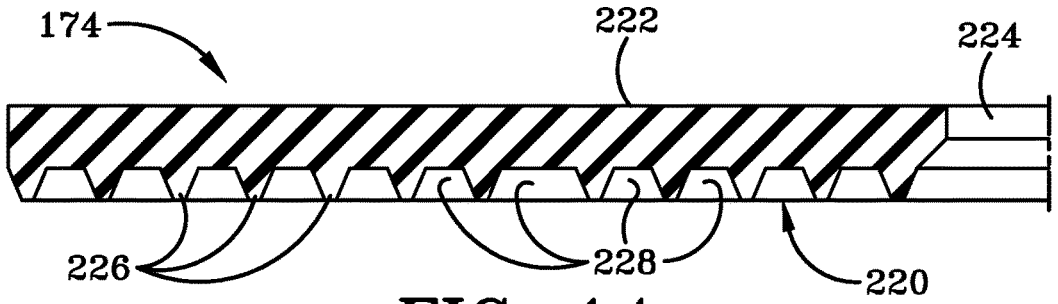
Figure 15:
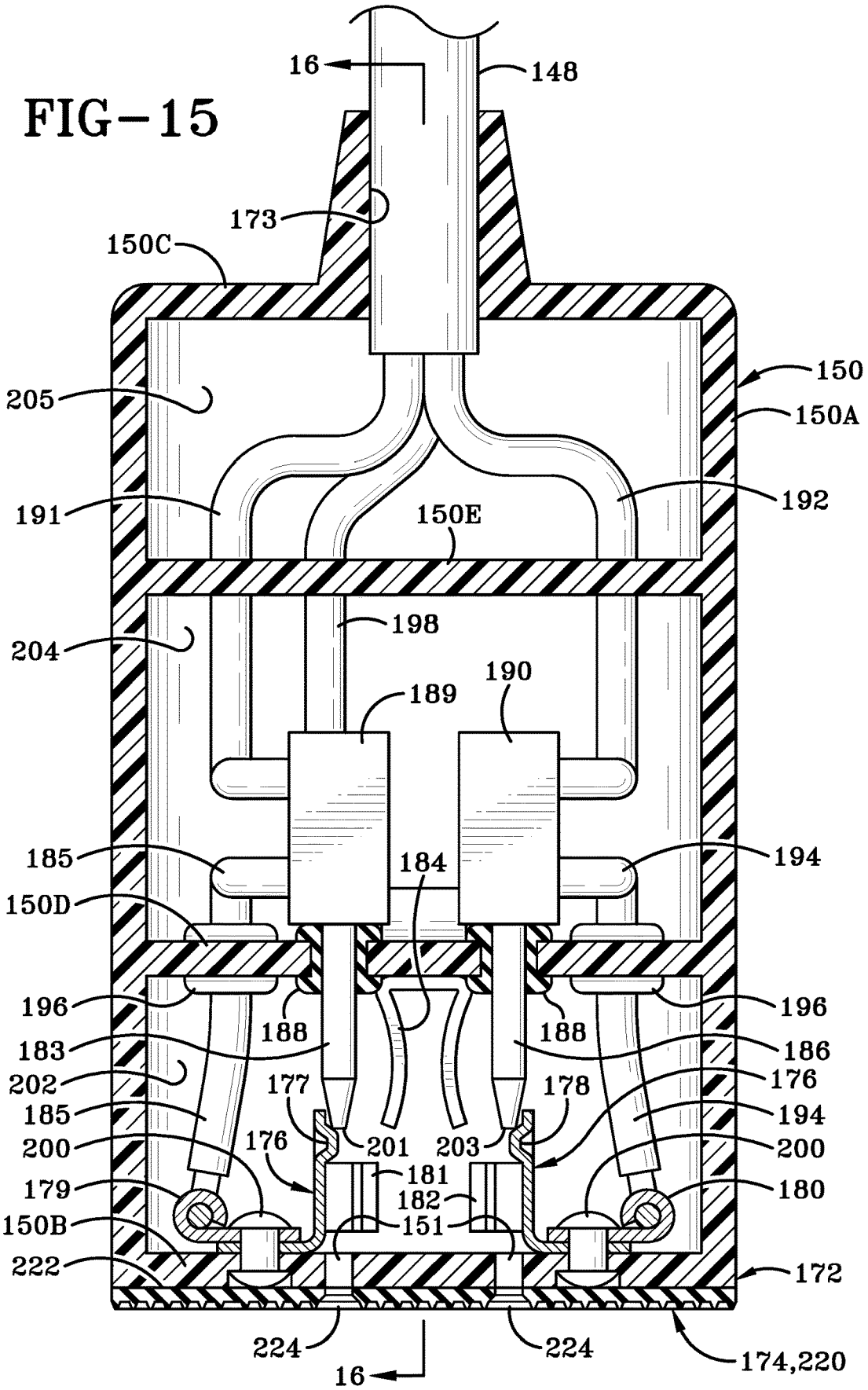
FIG. 15 is a sectional view taken generally about line 15-15 in FIG. 12.
Figure 16:
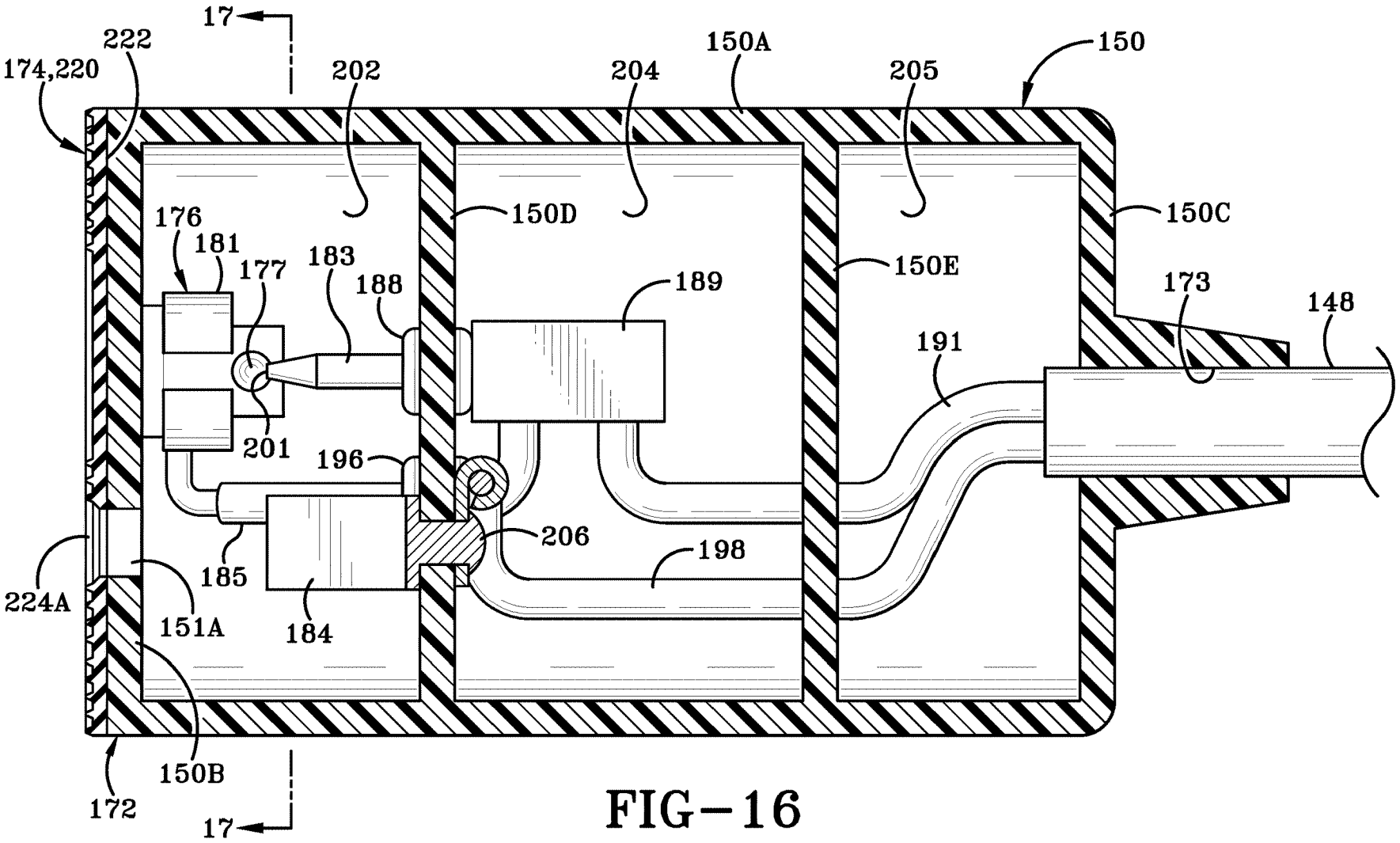
FIG. 16 is a sectional view taken generally about line 16-16 in FIG. 15.
Figure 17:
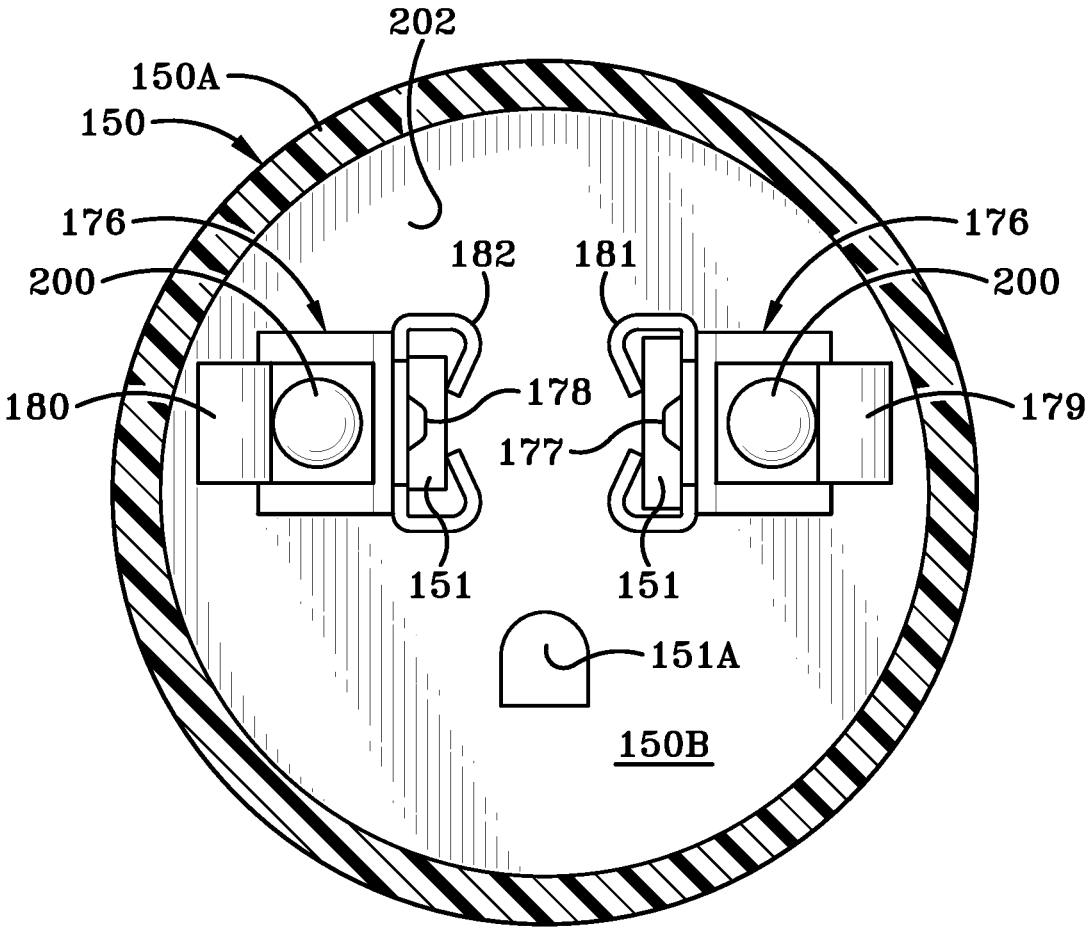
FIG. 17 is a sectional view taken generally about line 17-17 in FIG. 16.
Figure 18:
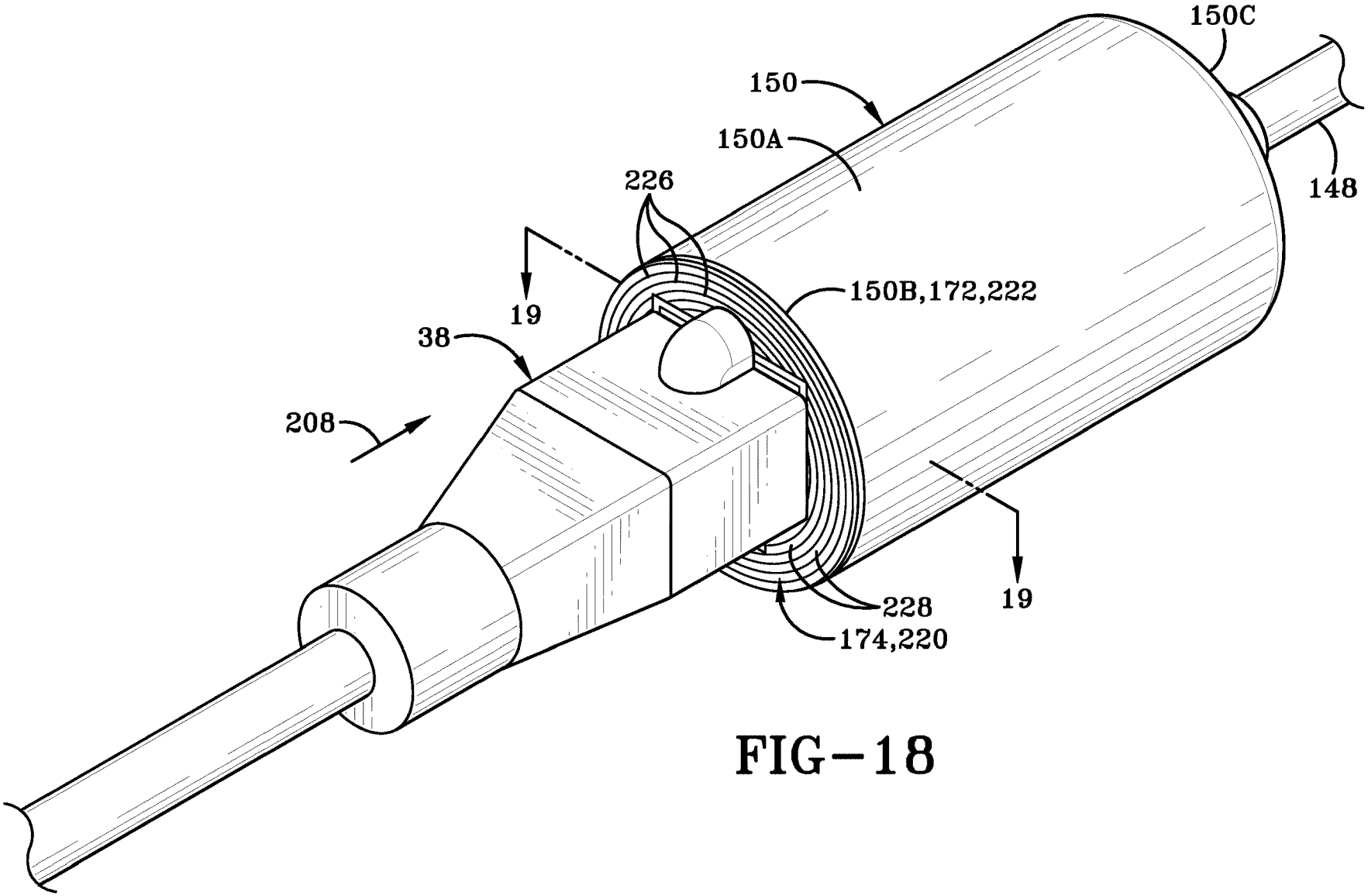
FIG. 18 is a perspective view of the first aspect electrical cord with an electrical plug inserted.
Figure 19:
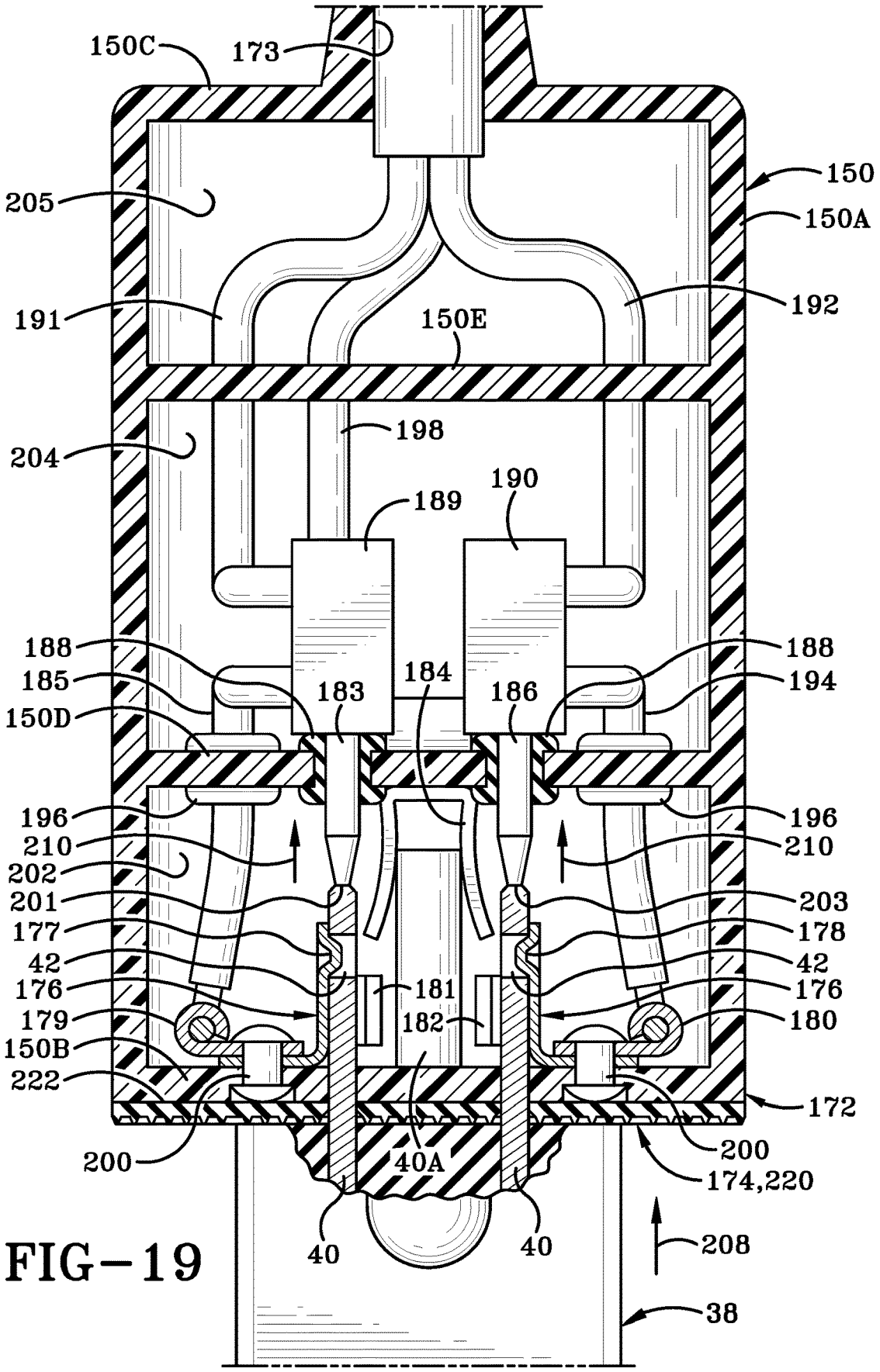
FIG. 19 is a sectional view taken generally about line 19-19 in FIG. 18.

FIGS. 9-11 illustrate additional electrical devices with similar features but oriented about a perimeter of the device instead of on a back surface of the electrical device as shown in FIGS. 6-8. First pin 130, second pin 132, and third pin 134 are positioned, generally equally, about the perimeter of the device. For convenience, the device is shown removed from the electrical receptacle 20C to show the details but a person of skill in the art will immediately appreciate that the device is positioned within an electrical receptacle and a recessed region 144 contacts a rear inner surface of the electrical receptacle to position the device appropriately.

Each of the first pin 130, the second pin 132, and the third pin 134 include top surfaces 146 which are oriented to contact to connect first pin 130 with first contactor end 136, to connect second pin 132 with second contactor end 138, and to connect third pin 134 with third contactor end 140. Contactor ends 136, 138, and 140 are parts of electrical connectors that may be generally flexible and are biased to connect the appropriate pins with the electrical contactor ends. Accordingly the user can rotate the device from the inactive position where no electrical communication occurs to an electrically active position where electrical communication flows through all three contactor ends and all three pins of the electrical device.

In another aspect, the electrical device may be rotatable 360 degrees or more so that there are multiple operational positions. Specifically, each of the pins 130, 132, and 134 may selectively contact various contactor end 136, 138, and 140. The device may be structured such that all that is required is electrical connections amongst the three contactor ends and the pins. In this orientation, the electrical receptacle 20C is a smart receptacle that can adjust the current to the device to properly orient the hot circuit, line circuit, and ground circuit at the device face to permit an electrical plug to receive the appropriate electrical current. This circuitry may include a semiconductor or other suitable electrical processing unit which is part of the electrical receptacle. Still further, the device may include only a single pin and contactor and function to electrically activate one or more of the circuits when the other remaining circuits stay in a fully active position, thus only a single pin is required to provide electrical continuity to the electrical plug inserted in the electrical receptacle.

In another aspect, a person of skill in the art will immediately appreciate that the electrical device face may be modified to provide more than one electrical receptacle apertures set on the electrical face and include any suitable number of independently and electrically isolated electrical connection points. For example, two faces may move rotationally together or independently or may slide vertically, horizontally, or at an angle. While not specifically shown, the same features may be implemented in any suitable electrical receptacle, whether on a power strip, surge protector, cord reel, power tap, extension cords, or the like.

FIGS. 12-19 illustrate various views of an electrical cord 148 connected to a cord end 150. Cord end 150 includes a first end 172 having a weather resistant surface 174. Weather resistant surface 174 may be composed on any suitable material including, but not limited to, rubber or silicone and may include a number of features surrounding and defining openings in the cord end 150 such as, for example, peaks 226 and valleys 228 formed in a front surface 220. The weather resistant surface 174 is helpful to prevent or limit water or other liquids from entering cord end 150. The weather resistant surface 174 includes front surface 220 and a back surface 222 with apertures 224 and 224A arranged to receive electrical plug prongs and grounding prongs therein.

Cord end 150 includes an outer wall 150A which may be cylindrical or any other suitable shape, a front wall 150B, and a back wall 150C.

Cord end 150 includes three chambers, a rear chamber 205 where electrical cord 148 enters through opening 173, a middle chamber 204 which houses circuit activators 189 and 190, and a forward chamber 202 which receives the electrical plug 38 and transmits electrical current from the electrical cord 148 to the electrical plug. A dividing wall 150D separates chambers 202 and 204, while a dividing wall 150E separates chambers 204 and 205. Forward chamber 202 includes plug terminals 176 which each include receiving portions 181 and 182 respectively to frictionally engage prongs of the electrical plug. Plug prong apertures 151 and 151A are arranged to permit access to the forward chamber 202. Further, a retention mechanism 177 and 178 are positioned on the plug terminals 176 to help retain the electrical plug within the cord end and may retain the plug at the various retention forces described above for other implementations. Plug terminals 176 may be secured to the forward chamber 202 with a rivet assembly 200 and a wire connection 179 and 180, respectively connects the plug terminals 176 to the appropriate wires 185 and 194. Wires 184 and 185 pass through a dividing wall between the middle and forward chambers through water resistant grommets 196 to further prevent water from infiltrating the middle chamber. Still further, a grounding terminal 184 is positioned in and secured to the forward chamber for receiving the electrical plug ground prong with a rivet 206 or other suitable mechanism.

Middle chamber 204 may also include ground wire 198 passing into the middle chamber from rear chamber 205, while a first electrical cable 191 and a second electrical cable 192 pass through the rear chamber into the middle chamber as well. First and second wires 191 and 192 each provide electrical current to circuit activators 189 and 190. Circuit activators 189 and 190 include plungers 183 and 186 which each extend from the middle chamber 204 into the forward chamber 202 through grommets 188. Each plunger 183 and 186 may include a terminating end 201 and 203. In operation, plungers 183 and 186 are compressible into circuit activators 189 and 190 when terminating ends 201 and 203 are forced in the direction associated with arrows 210 after the electrical plug is inserted in the direction associated with arrow 208. The electrical plug prongs contact terminating end 201 and 203 when inserted into the cord end. When plungers 183 and 186 are compressed enough, the cord end becomes electrically active. Specifically, circuit activators 189 and 190 transmit electrical current from first electrical cable 191 and second electrical cable 192, respectively, to receiving portions 181 and 182 of the plug terminals 176.

In one implementation, both circuit activators 189 and 190 must be compressed in order for electrical current to be conveyed to plug terminals 176. In another implementation, each circuit activator 189 and 190 operates independently of each other and provide electrical current to the respective plug terminal. In yet another implementation, both circuit activators 189 and 190 must be compressed simultaneously in order for electrical current to begin flowing to the plug terminals. Accordingly, when the electrical plug is connected to an electrical outlet, the cord end is electrically inactive until an electrical plug is inserted within the electrical cord end. Advantageously, this orientation ensures that the electrical cable and cord end are not shorted or grounded due to water entering the cord end when an electrical plug is not connected because the middle and rear chambers are sealed from liquids and electrical current is not flowing to the forward chamber. Still further, since weather resistant surface 174 seals against the electrical plug, water is much less likely to enter the forward chamber. Further, while not shown, a water detection prong may be positioned in the forward chamber and prevent electrical power from being transmitted to the forward chamber or cease providing electrical power to the forward chamber if water is detected. Accordingly, the cord end is isolated from operating when a liquid is present without an electrical plug and is able to limit the likelihood of a liquid entering the forward chamber when an electrical plug is inserted.

In the implementations shown and described above, a number of suitable alternatives may be utilized. By way of non-limiting example, the circuit activators 189 and 190 may utilize photo sensors to detect the presence of the electrical plug prongs, a circuit completing sensor, an optical sensor, a ground detecting sensor, a liquid presence sensor, or any other suitable detection mechanism to identify the presence of an electrical plug or a liquid therein. In any implementation, a smart circuit may require individual electrical plug presence or simultaneous presence and may activate the electrical cord to provide electrical current in a number of suitable situations depending on the desired application.

FIG. 20 illustrates a schematic view of an electrical receptacle in three positions, an electrical plug not engaged, an electrical plug engaged with the electrical receptacle, and a foreign object 153 inserted into the electrical receptacle. An electrical plug 152 includes a plurality of prongs 154. Tamper resistant guides 156 are positioned inside the electrical receptacle and a pivotable tamper resistant member 158 is rotatable about pivot point 160. A slider 162 is movable by tamper resistant member 158 until the slider 162 contacts circuit switch 164 at a contact bridge 166. Circuit bridge 166 closes the circuit between a line in contact 170 and a line out contact 168. In operation, when both prongs of 154 contact tamper resistant guides 156 simultaneously, the tamper resistant guides move towards tamper resistant member 158. With tamper resistant member 158 moved by both tamper resistant guides 156, rotation of the resistant member 158 is prevented and the tamper resistant member 158 moves the slider 162 into switch 164 and specifically contact bridge 166 to electrically activate the electrical receptacle.

When a foreign object 153 is inserted into the electrical receptacle, only one of the tamper resistant guides 156 moves towards and into contact with tamper resistant member 158. Since tamper resistant member 158 is contacted by only a single tamper resistant guide 156, a moment is created about tamper resistant member 158 at pivot point 160. Since tamper resistant member 158 is rotated instead of moved, switch 164 is not engaged and the electrical receptacle is not electrically active. Accordingly this orientation and structure provides a tamper resistant mechanism which can be incorporated into both an electrical receptacle, an electrical cord, or any other suitable device. This structure may be positioned within the device and a number of guides and channels may be formed in the device to accommodate the tamper resistant guides 156, tamper resistant member 158, slider 162, and switch 164 to permit the desired movement. In this orientation, the electrical receptacle is electrically inactive until the electrical plug and both prongs thereof are inserted into the electrical receptacle to activate the switch 164. Accordingly, a tamper resistant electrical device, receptacle, or plug is provided that can effectively be electrically inactive when an electrical plug is not present and then become electrically active when an electrical plug is present.

While this and other embodiments illustrate the use of a side-wired receptacle, a person of skill in the art will immediately appreciate that a back wired, side wired, hard wired, or any other suitable connection method to the structural wiring system may be utilized without departing from the spirit and scope of the present disclosure.

It will be understood that implementations are not limited to the specific components disclosed herein, as virtually any components consistent with the intended operation of a method and/or system implementation for an electrical receptacle or electrical cord may be utilized. Components may comprise any shape, size, style, type, model, version, class, grade, measurement, concentration, material, weight, quantity, and/or the like consistent with the intended operation of a method and/or system implementation for an electrical receptacle or electrical cord.

The concepts disclosed herein are not limited to the specific implementations shown herein. For example, it is specifically contemplated that the components included in a particular implementation of an electrical receptacle or electrical cord may be formed of any of many different types of materials or combinations that can readily be formed into shaped objects and that are consistent with the intended operation of an electrical receptacle or electrical cord. For example, the components may be formed of: rubbers (synthetic and/or natural) and/or other like materials; polymers and/or other like materials; plastics, and/or other like materials; composites and/or other like materials; metals and/or other like materials; alloys and/or other like materials; and/or any combination of the foregoing.

Furthermore, embodiments of the electrical receptacle or electrical cord may be manufactured separately and then assembled together, or any or all of the components may be manufactured simultaneously and integrally joined with one another. Manufacture of these components separately or simultaneously may involve extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, and/or the like. If any of the components are manufactured separately, they may then be coupled or removably coupled with one another in any manner, such as with adhesive, a weld, a fastener, any combination thereof, and/or the like for example, depending on, among other considerations, the particular material(s) forming the components.

In places where the description above refers to particular implementations of an electrical receptacle or an electrical cord, it should be readily apparent that a number of modifications may be made without departing from the spirit thereof and that these implementations may be applied to other electrical receptacles or electrical cords. The accompanying claims are intended to cover such modifications as would fall within the true spirit and scope of the disclosure set forth in this document. The presently disclosed implementations are, therefore, to be considered in all respects as illustrative and not restrictive, the scope of the disclosure being indicated by the appended claims rather than the foregoing description. All changes that come within the meaning of and range of equivalency of the claims are intended to be embraced therein.

We claim:

1. An electrical receptacle comprising:

a body comprising a first cavity with a first electrical connection and a second cavity with a second electrical connection; and a slider within the body configured to move between an electrically inactive position wherein the first electrical connection and the second electrical connection are not in electrical continuity and an electrically active position wherein the first electrical connection and the second electrical connection are in electrical continuity;

wherein the slider moves to the electrically active position when an electrical plug is inserted into at least one of the first cavity and the second cavity.

2. The electrical receptacle of claim 1, wherein the first electrical connection is only in electrical continuity with the second electrical connection when the electrical plug is positioned within at least one of the first cavity and the second cavity.

3. An electrical cord comprising the electrical receptacle of claim 1.

4. The electrical receptacle of claim 1, wherein at least one electrical connection of the first electrical connection and the second electrical connection is positioned to contact at least one electrical plug prong on the electrical plug when the electrical plug is positioned within at least one of the first cavity and the second cavity.

5. The electrical receptacle of claim 4, wherein the at least one electrical connection facilitates transmission of electrical current to the at least one electrical plug prong.

6. The electrical receptacle of claim 1, further comprising a device face with a plurality of electrical receptacle apertures extending therethrough.

7. The electrical receptacle of claim 6, wherein the device face is rotatable with respect to the body.

8. An electrical receptacle comprising:

a body comprising a first electrical connection and a second electrical connection;

a device face having a plurality of electrical receptacle apertures extending therethrough, the plurality of electrical receptacle apertures configured to receive an electrical plug therein; and a slider within the body configured to move between an electrically inactive position wherein the first electrical connection and the second electrical connection are not in electrical continuity and an electrically active position wherein the first electrical connection and the second electrical connection are in electrical continuity;

wherein the slider moves to the electrically active position when the electrical plug is inserted into the plurality of electrical receptacle apertures.

9. The electrical receptacle of claim 8, wherein the first electrical connection is only in electrical continuity with the second electrical connection when the electrical plug is positioned within the plurality of electrical receptacle apertures.

10. An electrical cord comprising the electrical receptacle of claim 8.

11. The electrical receptacle of claim 8, wherein the device face is rotatable with respect to the body.

12. The electrical receptacle of claim 8, wherein at least one electrical connection of the first electrical connection and the second electrical connection is positioned to contact at least one electrical plug prong on the electrical plug when the electrical plug is positioned within the plurality of electrical receptacle apertures.

13. The electrical receptacle of claim 12, wherein the at least one electrical connection facilitates transmission of electrical current to the at least one electrical plug prong.

14. A method of forming an electrical connection, the method comprising:

providing an electrical receptacle having a body with a first electrical connection and a second electrical connection and a device face with a plurality of electrical receptacle apertures extending therethrough, the plurality of electrical receptacle apertures configured to receive an electrical plug therein; and moving a slider within the body of the electrical receptacle from an electrically inactive position wherein the first electrical connection and the second electrical connection are not in electrical continuity to an electrically active position wherein the first electrical connection and the second electrical connection are in electrical continuity;

wherein the step of moving the slider from the electrically inactive position to the electrically active position comprises the step of inserting the electrical plug into the plurality of electrical receptacle apertures.

15. The method of claim 14, wherein the step of moving the slider from the electrically inactive position to the electrically active position comprises the step of turning on electrical current flow between the first electrical connection and the second electrical connection.

16. The method of claim 15, further comprising the step of turning off electrical current flow between the first electrical connection and the second electrical connection by moving the slider from the electrically active position to the electrically inactive position.

17. The method of claim 16, wherein the step of turning off electrical current flow between the first electrical connection and the second electrical connection further comprises electrically disconnecting the second electrical connection from the first electrical connection.

* * * * *